US006651748B2

(12) United States Patent
Sullaway et al.

(10) Patent No.: US 6,651,748 B2
(45) Date of Patent: Nov. 25, 2003

(54) METHODS AND APPARATUS FOR CREATING A DOWNHOLE BUOYANT CASING CHAMBER

(75) Inventors: Bobby L. Sullaway, Duncan, OK (US); Henry E. Rogers, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/299,530

(22) Filed: Nov. 18, 2002

(65) Prior Publication Data

US 2003/0070816 A1 Apr. 17, 2003

Related U.S. Application Data

(62) Division of application No. 09/655,623, filed on Aug. 31, 2000, now Pat. No. 6,505,685.

(51) Int. Cl.[7] ..... E21B 33/12; E21B 34/06; E21B 23/00

(52) U.S. Cl. ..... 166/386; 166/191; 166/327; 166/387

(58) Field of Search ..... 166/373, 374, 166/381, 383, 319, 386, 387, 327, 153, 191

(56) References Cited

U.S. PATENT DOCUMENTS

| | | | |
|---|---|---|---|
| 2,352,744 A | 7/1944 | Stodard | 166/1 |
| 3,358,770 A | 12/1967 | Zandmer | 166/224 |
| 3,526,280 A | 9/1970 | Aulick | 166/285 |

(List continued on next page.)

FOREIGN PATENT DOCUMENTS

| | | | |
|---|---|---|---|
| EP | 0 306 306 A1 | 9/1988 | E21B/33/05 |
| EP | 0 697 496 A2 | 2/1996 | E21B/33/16 |
| EP | 0 846 839 A2 | 6/1998 | E21B/43/10 |
| GB | 2 346 398 A | 8/2000 | E21B/43/10 |
| WO | WO 91/03620 | 3/1991 | E21B/33/14 |

OTHER PUBLICATIONS

SPE/IADC 13487 "Directional Drilling Using The Catenary Method" by R.T. McClendon et al., dated 1985.
SPE 15463 "Designing Well Paths To Reduce Drag and Torque" by M.C. Sheppard, dated 1986.
SPE 20094 "Extended–Reach Drilling From Platform Irene" by M.D. Mueller et al., dated 1990.
SPE 20818 "Extended–Reach Drilling From Platform Irene" by M.D. Mueller et al., dated 1991.
SPE 23027 "The Uses of Buoyancy in Completing High–Drag Horizontal Wellbores" by J.L. Hood et al., dated 1991.
IADC/SPE 23878 "Analysis of Buoyancy–Assisted Casings and Liners In Mega–Reach Wells" K.E. Ruddy et al., dated 1992.
SPE 30451 Advances In Extended Reach Drilling—An Eye to 10 km Stepout by G. Ryan et al. dated 1995.
SPE 50680 "Buoyancy Assist Extends Casing Reach In Horizontal Wells" by H.E. Rogers et al., dated 1998.

*Primary Examiner*—David Bagnell
*Assistant Examiner*—Jennifer H Gay
(74) *Attorney, Agent, or Firm*—John W. Wustenberg; Craig W. Roddy; Neal R. Kennedy

(57) ABSTRACT

Methods and apparatus for creating a downhole buoyant casing chamber. The buoyant casing chamber may be created after the casing has been at least partially run into the wellbore. Some embodiments also allow circulation of fluid as the casing is being run after the creation of the buoyant chamber. A method of the invention comprises running a length of casing into the well to a first step, forming a buoyant chamber in the casing, filling the chamber with buoyant fluid, either a gas or a light liquid, and running the casing to a second depth greater than the first depth. The apparatus used comprises a length of casing, a floating device disposed in a lower end of the casing and forming a lower boundary of a buoyant chamber, a packer for sealingly engaging the casing in an upper end of the buoyant chamber, and a volume of buoyant fluid to fill the chamber.

21 Claims, 3 Drawing Sheets

U.S. PATENT DOCUMENTS

| | | | | |
|---|---|---|---|---|
| 3,572,432 | A | | 3/1971 | Aulick ..... 166/114 |
| 4,384,616 | A | | 5/1983 | Dellinger ..... 166/376 |
| 4,413,682 | A | | 11/1983 | Callihan et al. ..... 166/382 |
| 4,457,377 | A | | 7/1984 | Burris, II ..... 166/332 |
| 4,457,379 | A | | 7/1984 | McStravick ..... 166/373 |
| 4,641,707 | A | | 2/1987 | Akkerman ..... 166/116 |
| 4,671,358 | A | | 6/1987 | Lindsey, Jr. et al. ..... 166/291 |
| 4,729,432 | A | | 3/1988 | Helms ..... 166/317 |
| 4,809,776 | A | | 3/1989 | Bradley ..... 166/153 |
| 4,953,622 | A | | 9/1990 | Lehr et al. ..... 166/327 |
| 4,986,361 | A | | 1/1991 | Mueller et al. ..... 166/381 |
| 5,086,843 | A | | 2/1992 | Mims et al. ..... 166/380 |
| 5,086,844 | A | | 2/1992 | Mims et al. ..... 166/383 |
| 5,117,915 | A | | 6/1992 | Mueller et al. ..... 166/381 |
| 5,150,756 | A | * | 9/1992 | Hassanzadeh ..... 166/318 |
| 5,170,847 | A | | 12/1992 | Mims et al. ..... 166/383 |
| 5,174,375 | A | | 12/1992 | Mims et al. ..... 166/117 |
| 5,181,571 | A | | 1/1993 | Mueller et al. ..... 166/381 |
| 5,379,835 | A | | 1/1995 | Streich ..... 166/181 |
| 5,392,852 | A | | 2/1995 | Laurel et al. ..... 166/153 |
| 5,413,172 | A | | 5/1995 | Laurel ..... 166/153 |
| 5,456,317 | A | | 10/1995 | Hood, III et al. ..... 166/296 |
| 5,472,053 | A | | 12/1995 | Sullaway et al. ..... 166/327 |
| 5,647,434 | A | | 7/1997 | Sullaway et al. ..... 166/242.8 |
| 5,829,526 | A | | 11/1998 | Rogers et al. ..... 166/291 |
| 5,881,814 | A | | 3/1999 | Mills ..... 166/313 |

* cited by examiner

METHODS AND APPARATUS FOR CREATING A DOWNHOLE BUOYANT CASING CHAMBER

This is a divisional of application Ser. No. 09/655,623, filed Aug. 31, 2000, now U.S. Pat. No. 6,505,685, issued Jan. 14, 2003.

BACKGROUND OF THE INVENTION

1. Field of the Invention

This invention relates to methods and apparatus for running casing into a wellbore, and more particularly, to methods and apparatus for creating a buoyant casing chamber in the casing to lighten the casing so that it may be run to a greater depth in the well.

2. Description of the Prior Art

In many wells, particularly horizontal or highly deviated wells, it is often difficult, if not impossible, to run well casing to the drilled depth of the well due to high casing drag usually caused by hole geometry, casing size, hole size, excess cutting in the hole. Creating a downhole buoyant chamber in the casing lightens it and increases the likelihood of success in getting casing to the bottom of the drilled hole. That is, if the string of casing can be made lighter, friction drag is reduced, and obstacles are more easily overcome.

U.S. Pat. Nos. 4,986,361; 5,117,915; and 5,181,571 disclose well casing flotation devices and methods of use. All of these patents are owned by Union Oil Company of California (UNOCAL). These patents relate to the creation of a buoyant casing chamber before the casing is run into the wellbore. The chamber cannot be created once the casing is run to its full depth. Also, the apparatus in these patents require that the operator determine the length of the air chamber prior to running the casing. Once the casing has been run into the wellbore, the length of the buoyant chamber cannot be changed.

The present invention solves this problem by providing, in some embodiments of the invention, for the creation of a buoyant casing chamber after the casing has been run a significant depth into the well. In this way, the length of the buoyant casing chamber can be determined based on downhole well conditions which might not be readily determined before the casing is run. This allows greater flexibility for the operator, and even avoids the necessity of creating a buoyant chamber if the casing can be run to the bottom of the well initially. Obviously, if the casing can be run to the bottom of the well, there is no need to incur the cost or take the time necessary to create a buoyant chamber.

When running the casing into the well, it is very desirable to have the ability to circulate fluid as the casing is being run in order to wash the casing past ledges and bridges often encountered, as well as providing lubrication for the casing to minimize drag on the wellbore. Also, it is often necessary to wash wellbore cuttings from horizontal and highly deviated sections of wellbores to allow passage of the casing. It may be further necessary to circulate large amounts of well cuttings out of the hole to allow passage of the casing.

U.S. Pat. Nos. 5,117,915 and 5,181,571, mentioned above, show an apparatus which allows circulation during the running-in of the casing. The present invention also provides different embodiments where fluids may be circulated while still providing a casing buoyant chamber.

SUMMARY OF THE INVENTION

The present invention provides for methods and apparatus for creating a downhole buoyant casing chamber. Each of the embodiments provides that the buoyant casing chamber may be created after the casing has been at least partially run into the wellbore. Certain of the embodiments also allow circulation of fluid as the casing is being run after the creation of the buoyant chamber.

Generally, the present invention includes a method of installing casing in a well in which the method comprises the steps of running a length of casing into the well to a first depth, forming a buoyant chamber in the casing, filling the chamber with a buoyant fluid, and running the casing to a second depth greater than the first depth. The buoyant fluid may be a gas or a liquid with a lower specific gravity than the well fluid.

In a first embodiment, the step of forming a buoyant chamber comprises sealing a lower end of the casing, providing a passageway inside the casing through which the buoyant fluid may be injected, and sealing between the casing and the passageway above the lower end of the casing. The casing preferably has a floating device adjacent to a lower end thereof, and the step of forming the buoyant chamber further comprises positioning a packer, with a subsurface release plug on a lower end thereof, in the casing above the floating device, actuating the packer into sealing engagement with the casing, releasing the plug from the packer, and injecting the buoyant fluid into the casing, thereby moving the plug downwardly into engagement with the floating device.

In another embodiment, the casing also has a floating device adjacent to a lower end thereof, and the step of forming the buoyant chamber comprises positioning tubing in the casing above the floating device, the tubing having a subsurface release plug on a lower end thereof and having a packer thereon above the plug, actuating the packer into sealing engagement with the casing, injecting the buoyant fluid above the plug, thereby moving the plug and tubing downwardly such that the plug is placed into engagement with the floating device. In running the casing to the second depth, fluid may be circulated through the tubing.

In a third embodiment, the first depth corresponds to a length of the buoyant chamber, and the casing has a floating device therein. In this embodiment, the step of forming the buoyant chamber comprises positioning tubing in the casing above the floating device, the tubing having a stinger on a lower end thereof and a packer above the stinger, actuating the packer into sealing engagement with the casing, thereby trapping the buoyant fluid in the buoyant chamber between the casing and tubing, and circulating fluid through the tubing.

The present invention may also be said to include a method of installing casing in a well comprising the steps of forming a buoyant chamber in a length of casing, running the casing into the well to a desired depth, and circulating fluid through the casing while running the casing into the wellbore.

The apparatus of the present invention generally comprises a length of casing, a floating device disposed in a lower end of the casing and forming a lower boundary of a buoyant chamber, sealing means for sealingly engaging the casing at an upper end of the buoyant chamber, and a volume of buoyant fluid to fill the buoyant chamber.

Numerous objects and advantages of the invention will become apparent as the following detailed description of the preferred embodiments is read in conjunction with the drawings which illustrate such embodiments.

DETAILED DESCRIPTION OF THE PREFERRED EMBODIMENT

First Embodiment

Figure 1A:
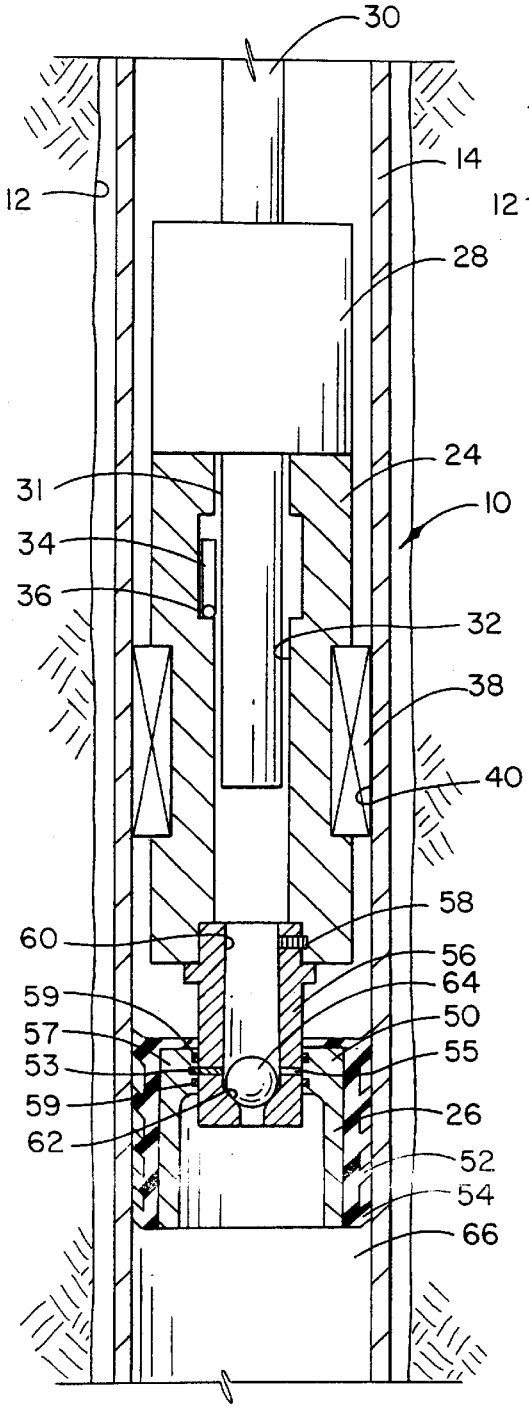
FIGS. 1A and 1B illustrate a first embodiment of the apparatus of the present invention for creating a downhole buoyant casing chamber.
Figure 1B:
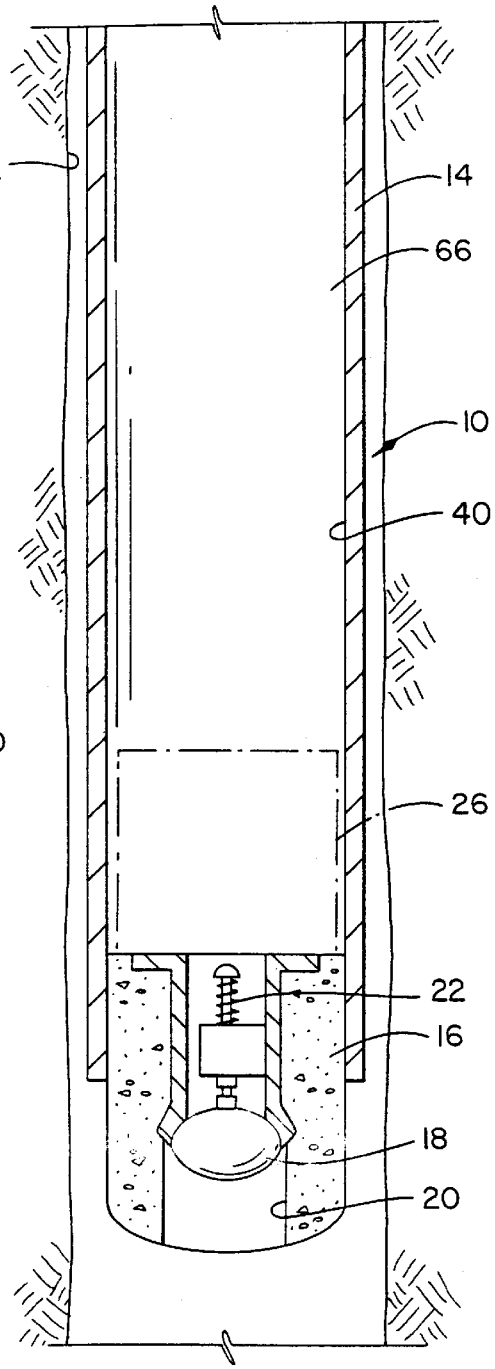

Referring now to the drawings, and more particularly to FIGS. 1A and 1B, a first embodiment of the apparatus for creating a downhole buoyant casing chamber is shown and generally designated by the numeral 10. First embodiment apparatus 10 is designed for creating the buoyant casing chamber after the casing has been run into a wellbore 12.

First embodiment apparatus 10 comprises a portion of casing 14 itself. This portion of casing 14 is a lower casing portion, and the casing has a float shoe 16 at the lower end thereof. Float shoe 16 is of a kind known in the art such as that shown in U.S. Pat. No. 5,647,434 to Sullaway et al., owned by the assignee of the present invention. Instead of a float shoe 16, a float collar could also be used. Float shoe 16 and similar float collars are frequently referred to as floating devices or floating equipment. As illustrated, float shoe 16 has a valve element 18 disposed in a central opening 20 defined in the float shoe. Similar float collars also have such valves. Valve element 18 is biased to a normally closed position by a biasing means, such as spring 22. Thus, valve element 18 acts as a check valve which prevents fluid from flowing upwardly through central opening 20 while allowing fluid to be pumped downwardly through the central opening.

In addition to a float shoe or float collar, a baffle collar could also be used.

The other major components of first embodiment apparatus 10 are a packer 24 and a subsurface release (SSR) type cementing plug 26 attached to the bottom of the packer.

A packer setting tool 28 and packer 24 are positioned in casing 14 on a length of coiled tubing 30. A stinger 31 of setting tool 28 extends through a central opening 32 of packer 24 such that the stinger holds open a flapper valve 34 in the packer. A seal 33 provides sealing between stinger 31 and central opening 32 above flapper valve 34. Flapper valve 34 is biased to its closed position by a biasing means, such as spring 36.

Packer 24 has a packer element 38 adapted for sealingly engaging bore 40 in casing 14 when the packer is actuated by setting tool 28 to the set position shown in FIG. 1A.

The general configuration of packer 24 is known in the art. One preferred type of packer is the Halliburton modified composite Fast Drill packer.

Subsurface release plug 26 is also of a kind generally known in the art, such as disclosed in U.S. Pat. Nos. 4,809,776; 5,392,852; and 5,413,172, all owned by the assignee of the present invention. Copies of those patents are incorporated herein by reference. Such an SSR plug 26 comprises a body 50 with an elastomeric jacket 52 thereon. Jacket 52 has a plurality of outwardly extending flexible wipers 54 thereon which engage bore 40 in casing 14.

SSR plug 26 is releasably attached to packer 24. In the illustrated embodiment, a retaining sleeve 56 interconnects packer 24 with SSR plug 26. Sleeve 56 is shearably attached to body 50 of SSR plug 26 by a shear pin 53.

Sleeve 56 is releasably retained in packer 24 by a releasing means, such as a shear pin 58. Other types of releasing means such as a collet, etc., could be used instead of shear pin 58.

Sleeve 56 defines at least one transverse sleeve port 55 therein adjacent to upper end 57 of plug 26. A sealing means, such as a pair of O-rings 59, provides sealing engagement between sleeve 56 and upper end 57 of plug 26 such that sleeve port 55 is initially closed.

Sleeve 56 also defines a bore 60 therein with an upwardly facing chamfered shoulder 62 at the lower end thereof. Shoulder 62 is adapted for engagement by a releasing ball 64 as will be further described herein.

In the method of use of first embodiment apparatus 10, casing 14 with float shoe 16 thereon is run into wellbore 12 until the friction drag on the casing with the walls of the wellbore will not allow the casing to be run to a greater depth with the rig equipment available. That is, casing 14 with float shoe 16 thereon is run to a first, no-go depth. This no-go depth is determined by hole conditions, the size of casing 14 and wellbore 12, cuttings in the wellbore, casing guiding equipment, centralizers and hole geometry.

While casing 14 is run into wellbore 12, the casing may be rotated, and fluid circulated down through the casing and through float shoe 16 to wash the casing to the no-go depth.

Once the no-go depth has been reached, packer 24 and plug 26 are run into casing 14 to the desired depth such that the packer forms an upper boundary of a buoyant chamber 66. It will be seen by those skilled in the art that float shoe 16 forms the lower boundary of buoyant chamber 66.

Packer 24 is set in well casing 14 by use of setting tool 28. Setting tool 28 may be of a kind known in the art, such as a powder-type setting tool run on coiled tubing or a hydraulic setting tool run on coiled tubing. Once packer 24 has been set with packer elements 38 sealingly engaging bore 40 in casing 14, and with stinger 31 on setting tool 28 holding flapper valve 34 in the open position, ball 24 is dropped into tubing 30 at the surface. Ball 64 is of a kind known in the art, such as made of a phenolic resin. Ball 64 is pumped with a buoyant fluid to pass through tubing 30 and through stinger 31 of setting tool 28 so that the ball seals on the seat formed by shoulder 62 in sleeve 56.

The buoyant fluid may be a gas, such as nitrogen, carbon dioxide or air, but other gases would also be suitable. The buoyant fluid may also be a liquid, such as water or diesel fuel, or other light liquid. The important aspect is that the buoyant fluid has a lower specific gravity than the well fluid in which the apparatus is run. The choice of gas or liquid, and which one of these is used, is a factor of the well conditions and the amount of buoyancy desired.

By increasing pressure in coiled tubing 30, sleeve 56 is forced downwardly until shear pin 58 is sheared which releases SSR plug 26 from packer 24.

By pumping the appropriate amount of buoyant fluid through tubing 30, a pressure differential is created on ball 64 and shoulder 62. This acts down on SSR plug 26 so that it is moved downwardly through casing 14 until it sealingly lands on float shoe 16 as shown by phantom lines in FIG. 1B. Thus, buoyant chamber 66 defined in casing 14 between packer 24 and SSR plug 26 on float shoe 16 is filled with the buoyant fluid. At this point, by pulling on tubing 30, setting tool 28 and stinger 31 thereof are moved away from packer 24. Spring 36 then moves flapper valve 34 to its closed position so that it holds pressure from above.

The buoyant fluid is thus trapped in buoyant chamber 66 when flapper valve 34 closes. The newly created buoyant-fluid-filled buoyant chamber 66 lightens casing 14 because of the increased buoyancy. Casing 14 may then be lowered to a second no-go depth.

Preferably, packer 24, SSR plug 26 and float shoe 16 are made of easily drillable materials. A drill bit (not shown) may be run on drill pipe into casing 14 on a clean-out trip to drill out packer 24, SSR plug 26 and float shoe 16. If a baffle collar or float collar is positioned above float shoe 16, it may not be necessary to drill out the float shoe.

After the steps of this method of creating a buoyant chamber have been carried out, additional operations may be conducted. For example, if it is desirable to cement casing 14 in wellbore 12, cementing operations can be easily performed in a conventional manner. To do this, additional pressure is applied in casing 14 to force sleeve 56 downwardly with ball 64 therein, thereby shearing shear pin 53. Sleeve 56 is moved downwardly such that sleeve port 55 is moved below upper end 57 of plug 26 and thus no longer sealed by O-rings 59. That is, sleeve ports 59 are open which thus opens SSR plug 26 for fluid flow therethrough.

Second Embodiment

Figure 2A:
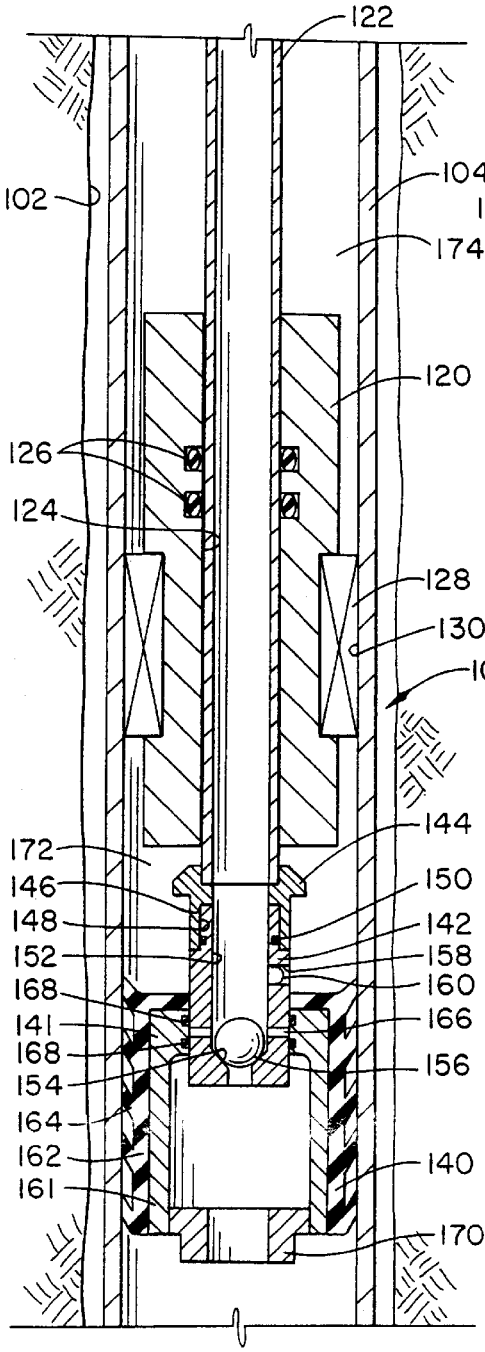
FIGS. 2A and 2B illustrate a second embodiment of the invention.
Figure 2B:
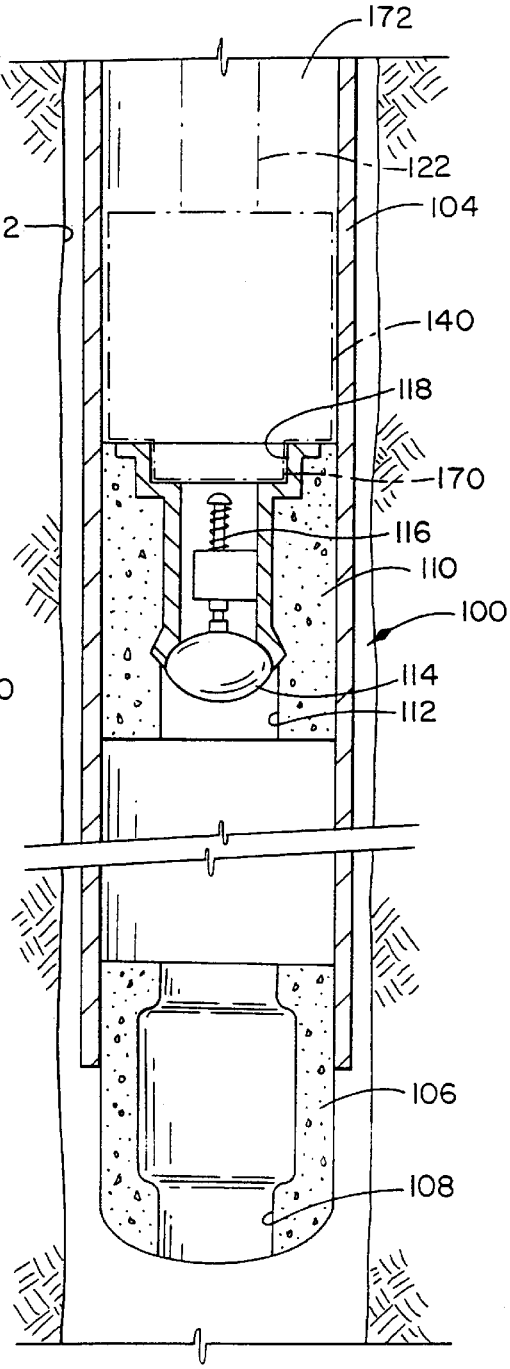

Referring now to FIGS. 2A and 2B, a second embodiment of the apparatus for creating a downhole buoyant casing chamber is shown and generally designated by the numeral 100. Apparatus 100 is shown positioned in a wellbore 102.

Apparatus 100 comprises a lower portion of well casing 104 with a guide shoe 106 of a kind known in the art at a lower end thereof. Guide shoe 106 defines a central opening 108 therethrough.

Positioned above guide shoe 106 is a floating device which is preferably a float collar 110. Float collar 110 defines a central opening 112 therethrough. A valve element 114 is disposed in central opening 112 and closes the central opening when in the closed position shown in FIG. 2B. Valve element 114 is biased to the closed position by a biasing means, such as a spring 116.

Float collar 110 defines a sealing sleeve or latching stab-in receptacle 118 at an upper end thereof.

Apparatus 100 also comprises a packer 120 positionable on coiled tubing 122 in casing 104 at a desired depth. One such packer is a coiled tubing packer, but others may be suitable. Tubing 122 may be stripped through a central opening 124 in packer 120. A sealing means, such as packing 126, provides sealing between packer 120 and tubing 122.

Packer 120 has a packer element 128 thereon adapted for sealing engagement with bore 130 in casing 104 when the packer is actuated to a set position.

A subsurface (SSR) plug 140 is attached at an upper end 141 thereof to the lower end of tubing 122 by a sleeve 142 and a collar 144. Sleeve 142 has an outside diameter 146 slidably received in a bore 148 in collar 144. A sealing means, such as an O-ring 150, provides sealing engagement between sleeve 142 and collar 144.

Sleeve 142 has a bore 152 therein with an upwardly facing chamfered shoulder 154 at the lower end thereof. Sleeve 142 is adapted to receive a ball 156 therein which may be dropped down tubing 122 as will be further described herein.

Sleeve 142 defines an upper transverse chamber port 158 therein above upper end 141 of plug 140. A closure means, such as a rupture disk 160, initially closes chamber port 158.

SSR plug 140 is of a kind generally known in the art such as shown in the previously mentioned patents assigned to the assignee of the present invention. Plug 140 has a body 161 with an elastomeric jacket 162 disposed therearound. Jacket 162 has a plurality of wipers 164 extending outwardly therefrom for wiping and sealing engagement with bore 130 in casing 104.

Sleeve 142 also defines a plurality of lower transverse sleeve ports 166 therein adjacent to upper end 141 of plug 140. A sealing means, such as a pair of O-rings 168, provides sealing engagement between sleeve 142 and upper end 141 of plug 140 such that sleeve ports 166 are initially closed.

At the lower end of body 161 of SSR plug 140 is a latch-type plug nose 170 adapted for latching and sealing engagement with stab-in receptacle 118 in float collar 110.

In the operation of second embodiment apparatus 100, casing 104 with guide shoe 106 and float collar 110 therein are run to a first, no-go depth in wellbore 102, in a manner similar to first embodiment 10. Fluid may be circulated downwardly through casing 104, float collar 110 and guide shoe 106 during this process.

Packer 120 and SSR plug 140 are run into casing 104 on tubing 122 to the top of the desired length of the buoyant chamber. Packer 120 is actuated into its set position so that packer element 128 sealingly engages bore 130 in casing 104. Ball 156 is dropped down tubing 120 so that it lands on the seat formed by shoulder 154 in sleeve 142. Pressure is applied in the tubing, such as by injecting a buoyant fluid. The buoyant fluid may be a gas or light liquid such as those mentioned in the operation of the first embodiment. Pressure is applied to rupture disk 160 to rupture it, thereby opening chamber port 158. Thus, opened chamber port 158 may be referred to as a flow path 158.

The pressure then causes a pressure differential across ball 156, shoulder 154 and SSR plug 140 which moves the SSR plug, and thus tubing 122, downwardly through casing 104. As tubing 122 is thus stripped down through packer 120, packing 126 maintains sealing engagement between the tubing and the packer. Eventually, nose 170 on SSR plug 140 latchingly and sealingly engages latching stab-in receptacle 118 in float collar 110 as shown in phantom lines in FIG. 2B.

A buoyant chamber 172, filled with the buoyant fluid through flow path 158, is thus formed above SSR plug 140 and below packer 120. Buoyant chamber 172 has an annular configuration between tubing 122 and casing 104.

Tubing 122 above packer 120 may be disconnected from the portion of the tubing below the packer by using a ball activated hydraulic disconnect (not shown) of a kind known in the art. This leaves a portion of the coiled tubing extending from SSR plug 140, through packer 120 and terminating a short distance above the packer. Thus, a central opening 174 in casing 104 above packer 120 is in communication with bore 152 in sleeve 142 through the remaining portion of tubing 122.

By applying sufficient additional pressure in casing 104, sleeve 142 is moved downwardly with respect to collar 144 and body 161 of plug 140 such that sleeve ports 166 in sleeve 142 are moved below upper end 141 of plug 140 and thus no longer sealed by O-rings 168. That is, sleeve ports 166 are opened. At the same time, chamber port 158 is moved downwardly so that it is sealingly separated from buoyant chamber 172 by at least one of O-rings 168, thus keeping buoyant chamber 172 closed.

It will be seen that central opening 174 in casing 104 is thus placed in communication with float collar 110 through sleeve ports 166 in sleeve 142.

Casing 104, now lighter because of buoyant chamber 172, may be further lowered into wellbore 102 until it reaches a second, no-go depth. Fluid may be circulated downwardly through central opening 174, tubing 122, sleeve ports 166, float collar 110 and guide shoe 106 to facilitate running casing 104 to the second depth.

Packer 120 and coiled tubing 122 may be retrieved from casing 104 using a drill-type work string and coiled tubing overshot (not shown) in a conventional manner. SSR plug 140 remains latched to float collar 110. After unseating packer element 128 from bore 130 in casing 104, the buoyant fluid in buoyant chamber 172 may be bled off up the casing and drill pipe annulus. At this point, casing 104 may be cemented into wellbore 102 through sleeve ports 166 in sleeve 142, float collar 110 and guide shoe 106 in a conventional manner and other well operations carried out.

Third Embodiment

Figures 3A, 3B:
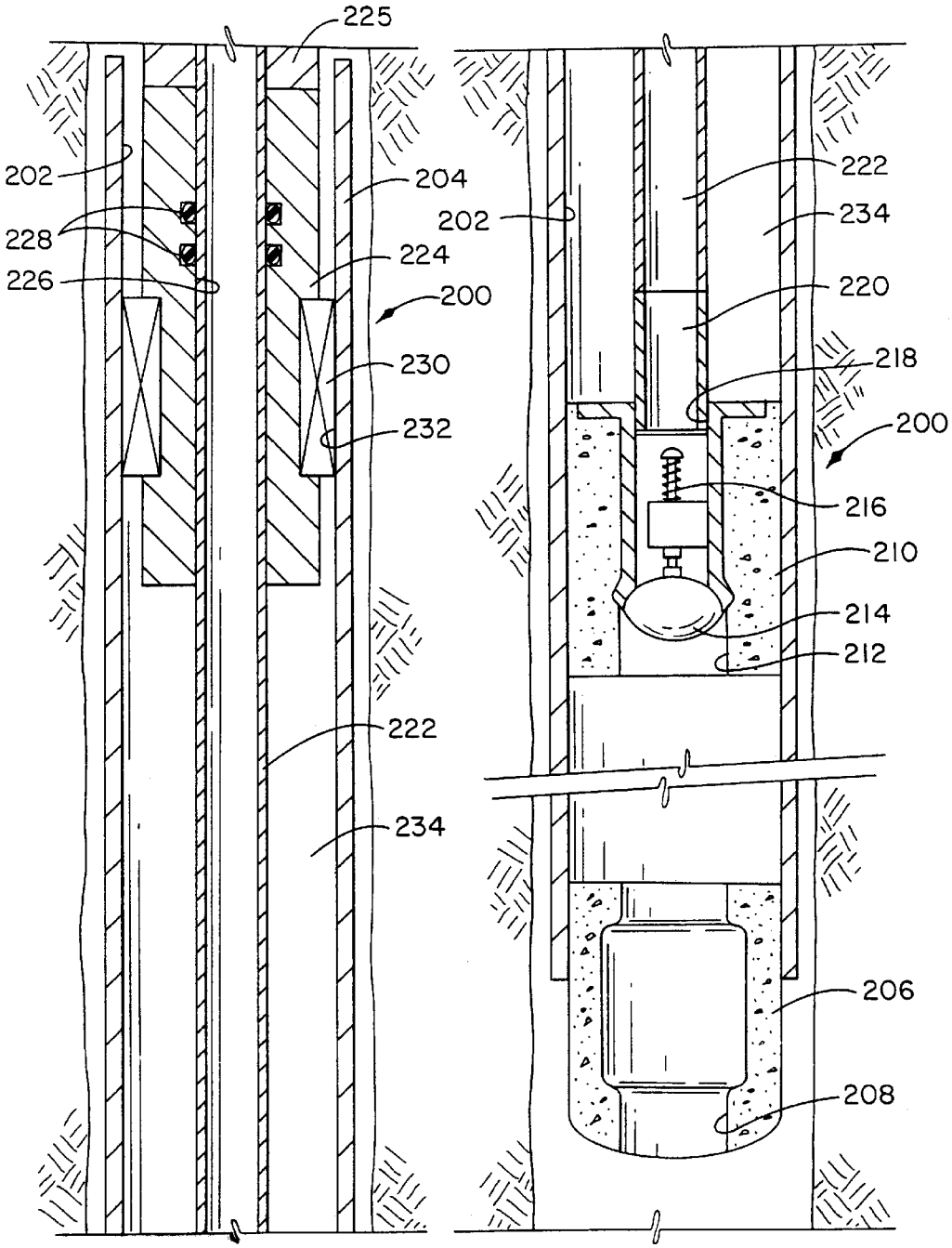
FIGS. 3A and 3B show a third embodiment of the invention.

Referring now to FIGS. 3A and 3B, a third embodiment of the apparatus for creating a downhole buoyant casing chamber is shown and generally designated by the numeral 200. Apparatus 200 is designed to be used in a wellbore 202.

Apparatus 200 comprises a lower portion of well casing 204 which has a guide or float shoe 206 at the lower end thereof. Guide or float shoe 206 is of a kind known in the art and defines a central opening 208 therethrough.

In a manner similar to second embodiment apparatus 100, third embodiment apparatus 200 also comprises a float collar 210 which is spaced above guide or float shoe 206. Float collar 210 defines a central opening 212 therethrough. A valve element 214 is disposed in central opening 212 and is shown in a closed position in FIG. 3B. Valve element 214 is biased to this closed position by a biasing means, such as spring 216.

Float collar 210 is preferably an innerstring float collar having a seal bore receptacle 218 therein.

As will be further described herein, seal bore receptacle 218 is adapted for engagement by a seal bore stinger 220 which is run on the bottom of internal tubing 222.

The last joint of tubing 222 is attached to the bottom of a packer 224. Packer 224 is preferably an inflatable or retrievable packer positionable by a known running tool or connector 225. Packer 224 defines a central opening 226 through which tubing 222 extends. A sealing means, such as packing 228, provides sealing engagement between tubing 222 and packer 224.

Packer 224 has a packer element 230 thereon adapted for sealing engagement with bore 232 in casing 204.

In the operation of third embodiment apparatus 200, casing 204, with float collar 210 and guide shoe 206 thereon, is run to a first depth in wellbore 202. This first depth is substantially equal to the desired length of the buoyant chamber to be created in apparatus 200. Casing 204 is run into wellbore 202 to this depth without filling the casing with well fluids. Valve element 214 in float collar 210 prevents well fluids from entering casing 204. That is, casing 204 may simply remain filled with ambient air as a buoyant fluid. If desired, casing 204 may be filled at this point with another buoyant fluid such as any of the gases or liquids previously mentioned for the other embodiments.

Tubing 222 is positioned through packer 224. Stinger 220 is run into casing 204 on tubing 222 so that the stinger stings into, and seals in, seal bore receptacle 218 of float collar 210. Thus, tubing 222 is placed in communication with central opening 212 in float collar 210.

Packer 224 on tubing 222 is set in casing 204 at the top joint of the casing so that packer element 230 sealingly engages bore 232. Thus, a buoyant-fluid-filled buoyant chamber 234 is formed below packer 220 and above float collar 210. Buoyant chamber 234 has an annular configuration between tubing 222 and casing 204.

Additional lengths of casing are attached to casing 204, and the casing is run into wellbore 202, thus carrying buoyant chamber 234 to the bottom of the wellbore. The well may be circulated during this running of casing 204 by pumping fluids down through tubing 222, float collar 210 and guide shoe 206 without disturbing buoyant chamber 234.

Casing 204 is thus run to a second depth which will generally be a no-go depth. This no-go depth is greater than would normally be reached because of the buoyancy provided by buoyant chamber 234.

After the casing has been run to the second depth, packer 224 may be unseated and the packer and tubing retrieved. The buoyant fluid in buoyant chamber 234 may be bled up the casing and drill pipe annulus.

Additional operations may then be carried out in the conventional manner, such as cementing casing 204 in wellbore 202.

It will be seen, therefore, that the method and apparatus for creating a downhole buoyant casing chamber are well adapted to carry out the ends and advantages mentioned as well as those inherent therein. While presently preferred embodiments of the apparatus and steps in the methods have been shown for the purposes of this disclosure, numerous changes in the arrangement and construction of parts in the apparatus and steps in the methods may be made by those skilled in the art. All such changes are encompassed within the scope and spirit of the appended claims.

What is claimed is:

1. A method of installing casing in a well comprising the steps of:

(a) running a length of casing having a floating device adjacent to a lower end thereof into the well to a first depth;

(b) forming a buoyant chamber in the casing, comprising:
positioning tubing in the casing above the floating device, the tubing having a subsurface release plug on a lower end thereof and having a packer thereon above the plug; and
actuating the packer into sealing engagement with the casing thereby forming the buoyant chamber between the packer and plug;

(c) filling the chamber with a buoyant fluid; and (d) running the casing to a second depth greater than the first depth.

2. The method of claim 1 further comprising:

during step (d), circulating fluid through the tubing.

3. The method of claim 2 further comprising:

(e) placing the tubing in communication with a portion of the well casing below the plug.

4. The method of claim 3 wherein step (e) comprises actuating a sleeve by applying pressure thereto such that a port defined in the sleeve is opened.

5. The method of claim 1 wherein the buoyant fluid is gas selected from the group consisting of nitrogen, air and carbon dioxide.

6. The method of claim 1 wherein the buoyant fluid is a liquid selected from the group consisting of diesel fuel and water.

7. A method of installing casing in a well comprising the steps of (a) forming a buoyant chamber in a length of casing having a floating device adjacent to a lower end thereof, comprising:
positioning tubing in the casing above the floating device, the tubing having a subsurface release plug on a lower end thereof and having a packer thereon above the plug; and
actuating the packer into sealing engagement with the casing thereby forming the buoyant chamber between the packer and plug;

(b) running the casing into the well to a desired depth; and (c) during step (b), circulating fluid through the casing.

8. The method of claim 7 wherein:

step (c) comprises circulating fluid through the tubing.

9. The method of claim 7 further comprising:

(d) placing the tubing in communication with a portion of the well casing below the plug.

10. The method of claim 9 wherein step (d) comprises actuating a sleeve by applying pressure thereto such that a port defined in the sleeve is opened.

11. An apparatus for forming a buoyant chamber in a well casing, the apparatus comprising:

a length of the casing;

a floating device disposed in a lower end of the casing and forming a lower boundary of the buoyant chamber;

sealing means for sealingly engaging the casing at an upper end of the buoyant chamber, the sealing means comprising a packer forming an upper boundary of the buoyant chamber when in sealing engagement with the casing;

a volume of buoyant fluid to fill the buoyant chamber;

tubing extending through the packer whereby the packer is positioned in the casing;

a flow path below the packer through which the buoyant fluid may be injected into the buoyant chamber; and a plug below the flow path and connected to a lower end of the tubing, the plug and tubing being adapted for moving downwardly in the buoyant chamber such that the plug is engaged with the floating device as the gas is injected into the buoyant chamber above the plug.

12. The apparatus of claim 11, further comprising:

a rupture disk initially disposed in the flow path and adapted for rupturing at a predetermined pressure, thereby placing the tubing and buoyant chamber in communication.

13. The apparatus of claim 11 further comprising a sleeve defining a sleeve port therein, the sleeve being disposed in the plug and having an initially closed position and being movable to an open position, after the plug is engaged with the floating device, such that the tubing is placed in communication with the floating device.

14. The apparatus of claim 13 wherein the sleeve is moved by a ball dropped down the tubing and pressure applied thereto.

15. The apparatus of claim 14 wherein the sleeve further defines a chamber port therein; and further comprising a rupture disk in the chamber port adapted for rupturing at a predetermined pressure after the ball has been dropped, thereby placing the tubing and buoyant chamber in communication.

16. method of installing casing in a well comprising the steps of:

(a) running a length of casing having a floating device adjacent to a lower end thereof into the well to a first depth;

(b) forming a buoyant chamber in the casing, comprising:

positioning tubing in the casing above the floating device, the tubing having a subsurface release plug on a lower end thereof and having a packer thereon above the plug; and actuating the packer into sealing engagement with the casing;

(c) filling the chamber with a buoyant fluid, comprising injecting the buoyant fluid above the plug, thereby moving the plug and tubing downwardly such that the plug is placed into engagement with the floating device; and (d) running the casing to a second depth greater than the first depth.

17. The method of claim 16 wherein step (c) comprises:

rupturing a rupture disc in communication with the tubing so that the buoyant fluid may be injected above the plug.

18. The method of claim 16 further comprising:

disconnecting the tubing from the packer at a location thereabove.

19. A method of installing casing in a well comprising the steps of:

(a) forming a buoyant chamber in a length of casing having a floating device adjacent to a lower end thereof, comprising:

positioning tubing in the casing above the floating device, the tubing having a subsurface release plug on a lower end thereof and having a packer thereon above the plug:

actuating the packer into sealing engagement with the casing; and injecting the buoyant fluid above the plug, thereby moving the plug and tubing downwardly such that the plug is placed into engagement with the floating device;

(b) running the casing into the well to a desired depth; and (c) during step (b), circulating fluid through the casing.

20. The method of claim 19 wherein step (a) comprises:

rupturing a rupture disc in communication with the tubing so that the buoyant fluid may be injected above the plug.

21. The method of claim 19 further comprising:

disconnecting the tubing from the packer at a location above the packer.

* * * * *